US006893182B1

(12) United States Patent
Liao

(10) Patent No.: US 6,893,182 B1
(45) Date of Patent: May 17, 2005

(54) SOAP HAVING EMBEDDED SPONGY CLEANSING DEVICE

(76) Inventor: Chung Min Liao, P.O. Box 63-99, Taichung (TW) 406

( * ) Notice: Subject to any disclaimer, the term of this patent is extended or adjusted under 35 U.S.C. 154(b) by 20 days.

(21) Appl. No.: 10/759,490

(22) Filed: Jan. 14, 2004

(51) Int. Cl.[7] ..... A47K 7/03
(52) U.S. Cl. ..... 401/200; 401/201
(58) Field of Search ..... 401/40, 41, 119, 401/146, 200, 201; 15/209.1, 210.1, 229.11

(56) References Cited

U.S. PATENT DOCUMENTS 3,343,196 A 9/1967 Barnhouse
5,650,384 A 7/1997 Gordon et al. ..... 510/159
5,727,278 A 3/1998 Per-Lee ..... 15/229.11
6,161,246 A * 12/2000 Trachtenberg ..... 15/229.13

* cited by examiner

*Primary Examiner*—Gregory L. Huson
*Assistant Examiner*—Peter deVore

(57) ABSTRACT

A soap device includes a sheet of flexible netting-like material having a number of perforations and an outer peripheral portion, and a soap material is engaged into the perforations of the sheet of flexible netting-like material, and engaged onto the outer peripheral portion of the sheet of flexible netting-like material to form the soap device. One or more further sheets of flexible netting-like material may further be engaged into the soap material and superposed with the other sheets of flexible netting-like material. The flexible netting-like sheets may be formed into different roughness or coarseness.

2 Claims, 3 Drawing Sheets

SOAP HAVING EMBEDDED SPONGY CLEANSING DEVICE

BACKGROUND OF THE INVENTION

1. Field of the Invention

The present invention relates to a soap device, and more particularly to a soap device having a spongy or perforated cleansing device embedded therein.

2. Description of the Prior Art

Various kinds of typical cleansing devices have been developed and comprise a puff-shaped structure formed or folded by one or more inelastic flexible netting-like materials or hydrophobic diamond-mesh sponge, to provide a multiplicity of ruffles bunched together.

For example, U.S. Pat. No. 3,343,196 to Barnhouse, and U.S. Pat. No. 5,727,278 to Per-Lee disclose two of the typical cleansing devices each having a spongy or puff-like structure for cleansing the skin of the users. The typical cleansing devices have no soap or cleansing and moisturizing composition disposed therein, such that the users have to use or to apply the soap or the cleansing and moisturizing composition onto their bodies, and then use the typical cleansing devices to clean their bodies.

U.S. Pat. No. 5,650,384 to Gordon et al. discloses another typical cleansing device including a polymeric diamond mesh bath sponge and having a liquid cleanser with moisturizer engaged therein. However, the liquid cleanser may be easily disengaged from the polymeric diamond mesh bath sponge, or may be quickly used up.

The present invention has arisen to mitigate and/or obviate the afore-described disadvantages of the conventional soap devices.

SUMMARY OF THE INVENTION

The primary objective of the present invention is to provide a soap device including a spongy or perforated cleansing device embedded therein for facilitating the cleansing operation of the soap device.

In accordance with one aspect of the invention, there is provided a soap device comprising a sheet of flexible netting-like material including a plurality of perforations formed therein, and including an outer peripheral portion, and a soap material engaged into the perforations of the sheet of flexible netting-like material, and engaged onto the outer peripheral portion of the sheet of flexible netting-like material to form the soap device.

One or more second sheets of flexible netting-like material may further be provided and engaged into the soap material and superposed with the sheet of flexible netting-like material, and include an outer peripheral portion having the soap material provided thereon. The flexible netting-like sheets may be formed into different roughness or coarseness.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
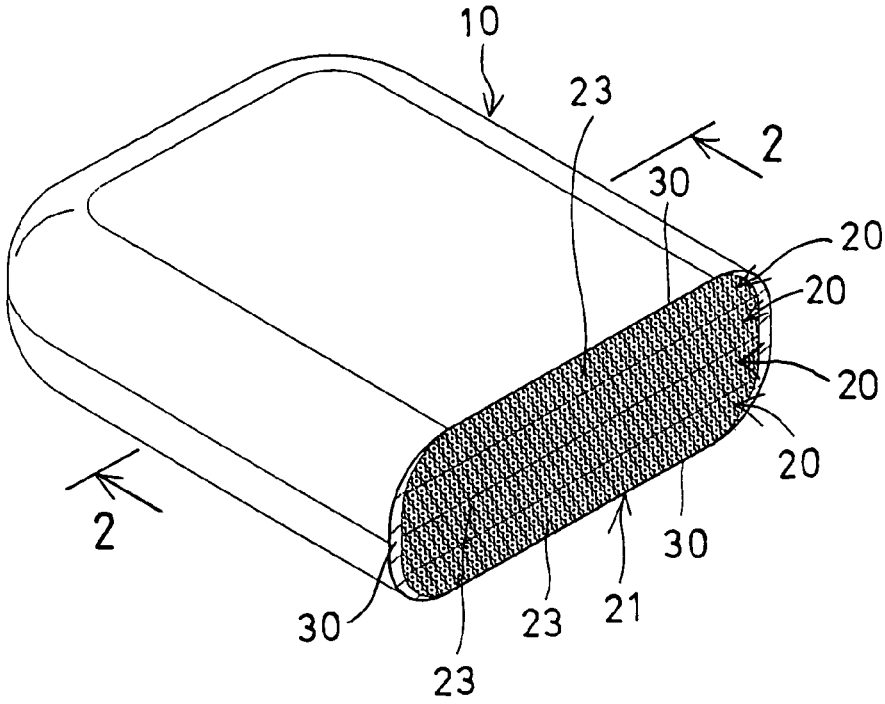
FIG. 1 is a perspective view of a soap device in accordance with the present invention, in which a portion of the soap device has been cut off to show an inner structure of the soap device.
Figure 2:
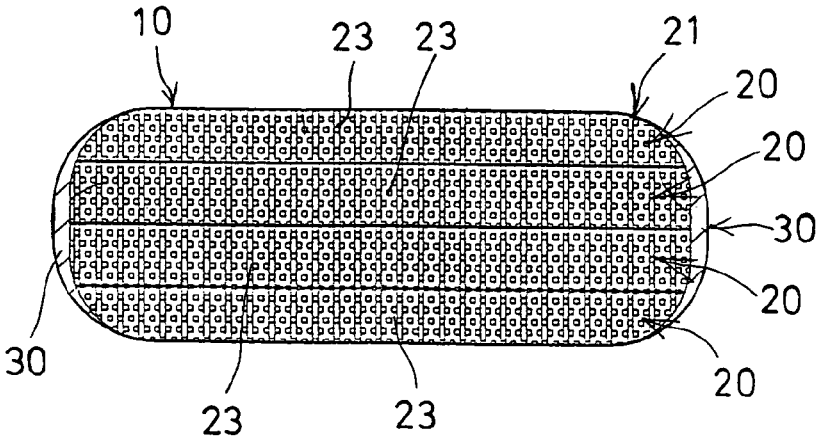
FIG. 2 is a cross sectional view taken along lines 2—2 of FIG. 1.

Referring to the drawings, and initially to FIGS. 1 and 2, a soap device 10 in accordance with the present invention comprises one or more layers or sheets 20 of hydrophobic mesh sponge materials, foamable materials, fiber materials, or inelastic flexible netting-like materials, or the like and a soap material 30 attached into and onto the outer peripheral portion 21 of the sheets 20 and having a cleansing and moisturizing composition provided therein for forming the soap device 10.

Figure 3:
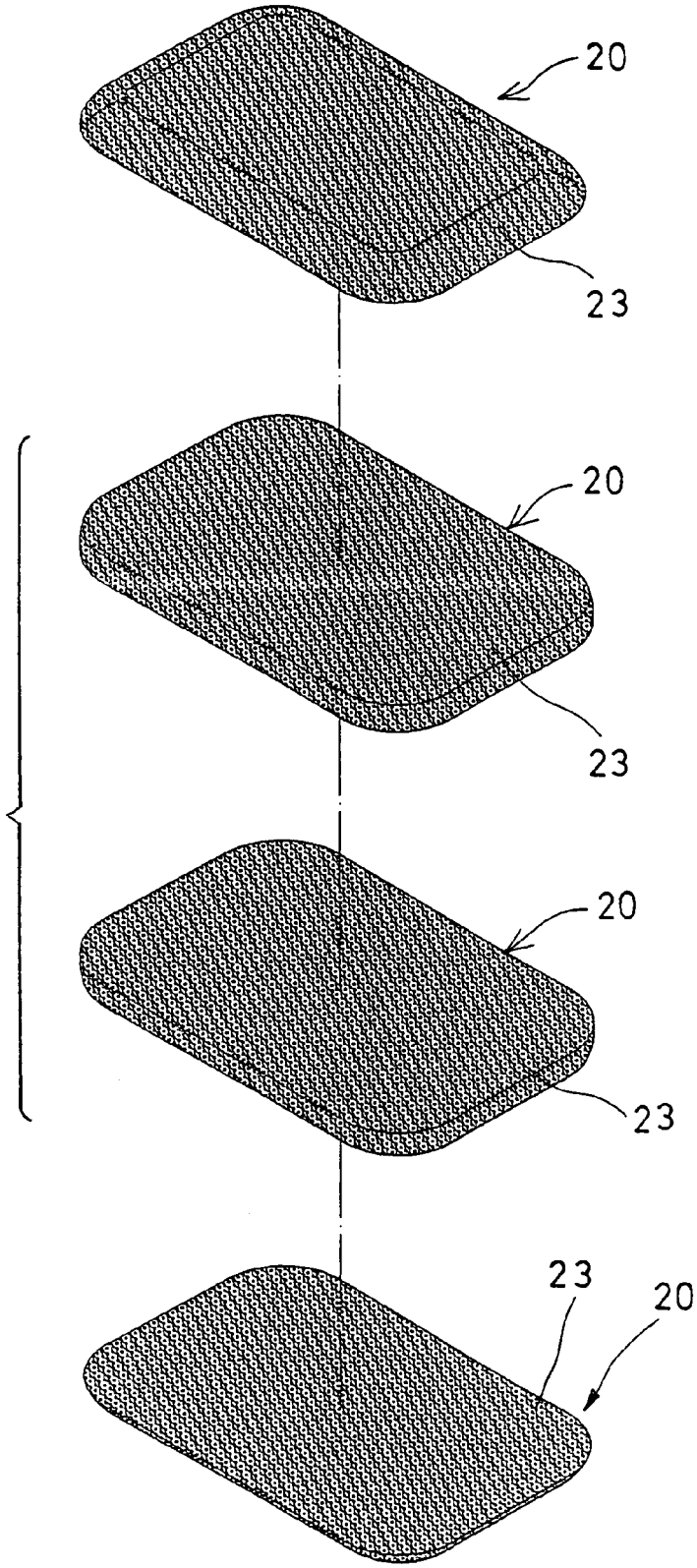
FIG. 3 is a partial exploded view of the soap device.
Figure 4:
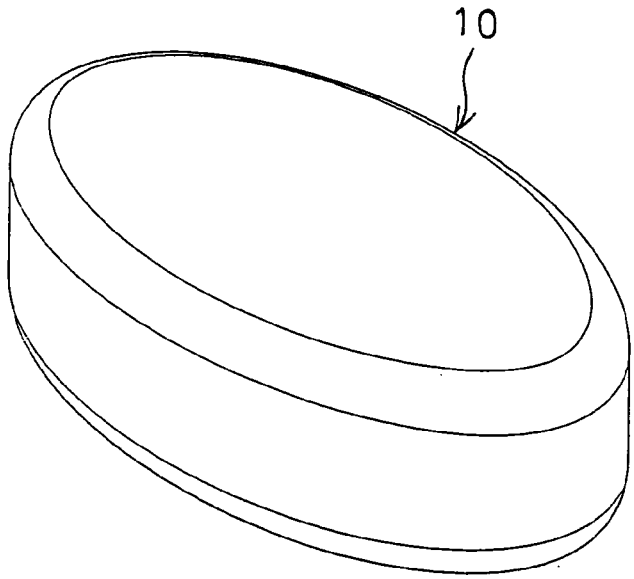
FIG. 4 is a perspective view illustrating the other contour or shape of the soap device.

Relatively, the soap device 10 includes one or more, such as four layers or sheets 20 (FIG. 3) of hydrophobic mesh sponge materials or foamable materials or inelastic flexible netting-like materials engaged within or embedded within the soap material 30. The soap device 10 may be formed into various kinds of outer contours or shapes, such as substantially parallelepiped shape (FIGS. 1, 2), oval shape (FIG. 4) or the like.

Figure 5:
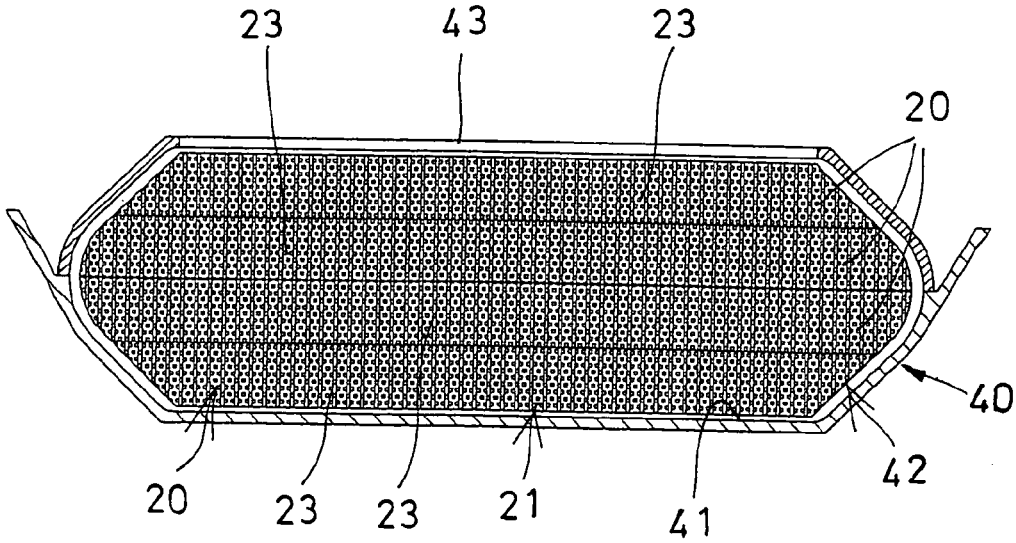
FIG. 5 is a cross sectional view illustrating a mold device for forming or manufacturing the soap device.

As shown in FIG. 5, illustrated is a mold device 40 for forming or manufacturing the soap device 10. The mold device 40 includes a mold cavity 41 formed therein to receive the flexible netting-like sheets 20 therein, and to form a peripheral gap or channel 42 between the mold device 40 and the sheets 20. The mold device 40 includes an opening 43 formed in the upper portion thereof for engaging the flexible netting-like sheets 20 into the mold cavity 41 of the mold device 40.

Each of the inelastic flexible netting-like sheets 20 includes a number of holes or perforations 23 formed therein. In manufacturing the soap device 10, a first sheet 20 of the netting-like sheets 20 may first be engaged into the mold cavity 41 of the mold device 40, and the soap material 30, in liquid or pasty state, is then poured into the mold cavity 41 of the mold device 40, and engaged into the peripheral channel 42 defined between the mold device 40 and the first sheet 20 and the perforations 23 of the first sheet 20.

Before the soap material 30 is hardened or cured, a second sheet 20 of the netting-like sheets 20 may then be engaged into the mold cavity 41 of the mold device 40, and disposed or superposed on the second sheet 20, and the other soap material 30, in liquid or pasty state, is then poured into the mold cavity 41 of the mold device 40, and engaged into the peripheral channel 42 defined between the mold device 40 and the second sheet 20 and the perforations 23 of the second sheets 20.

Similarly, the third sheet 20 and the fourth sheet 20 and the like may then be engaged into the mold cavity 41 of the mold device 40, and disposed or superposed on the previous sheets 20, and the further soap material 30, in liquid or pasty state, may then be poured into the mold cavity 41 of the mold device 40, and engaged into the peripheral channel 42 defined between the mold device 40 and the other sheets 20 and the perforations 23 of the other sheets 20.

After the soap material 30 is hardened or cured, the netting-like sheets 20 may then be solidly formed or embedded within the soap material 30, and/or formed on the outer peripheral portion of the soap material 30, to form the soap device 10. The soap material 30 may be gradually released from the netting-like sheets 20 while in use.

It is to be noted that the netting-like sheets 20 may include the perforations 23 that have different opening sizes or diameters or the like, and/or may be formed into various or different roughness or coarseness or the like.

Accordingly, the soap device in accordance with the present invention includes a spongy or perforated cleansing device embedded therein for facilitating the cleansing operation of the soap device.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A soap device comprising:

a first sheet of flexible netting-like material including a plurality of perforations formed therein, and including an outer peripheral portion, at least one second sheet of flexible netting-like material disposed on said first sheet of flexible netting-like material and superposed with said first sheet of flexible netting-like material, and including a plurality of perforations formed therein, and including an outer peripheral portion, and a soap material engaged into said perforations of said first and said at least one second sheet of flexible netting-like materials, and cured and embedded within said first and said at least one second sheet of flexible netting-like materials to form said soap device, and to allow said soap material to be gradually released from said first and said at least one second sheet of flexible netting-like materials.

2. The soap device as claimed in claim 1, wherein said soap material is engaged onto said outer peripheral portions of said first and said at least one second sheet of flexible netting-like materials.

* * * * *